US008905529B2

(12) United States Patent
Watanabe et al.

(10) Patent No.: US 8,905,529 B2
(45) Date of Patent: Dec. 9, 2014

(54) INKJET RECORDING DEVICE

(71) Applicants: Tatsuro Watanabe, Miyagi (JP); Kengo Tsubaki, Miyagi (JP); Hiroyoshi Komaba, Kanagawa (JP); Yoshiya Itoh, Kanagawa (JP)

(72) Inventors: Tatsuro Watanabe, Miyagi (JP); Kengo Tsubaki, Miyagi (JP); Hiroyoshi Komaba, Kanagawa (JP); Yoshiya Itoh, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/789,823

(22) Filed: Mar. 8, 2013

(65) Prior Publication Data

US 2013/0235131 A1 Sep. 12, 2013

(30) Foreign Application Priority Data

Mar. 12, 2012 (JP) ..... 2012-054317
Aug. 20, 2012 (JP) ..... 2012-181499

(51) Int. Cl.
*B41J 2/175* (2006.01)

(52) U.S. Cl.
CPC ..... *B41J 2/17523* (2013.01); *B41J 2/17509* (2013.01)
USPC ..... 347/86

(58) Field of Classification Search
CPC ..... B41J 2/155; B41J 2/19; B41J 2/17523; B41J 2202/21
USPC ..... 347/84–86
See application file for complete search history.

(56) References Cited

U.S. PATENT DOCUMENTS

| | | | | |
|---|---|---|---|---|
| 5,903,292 | A * | 5/1999 | Scheffelin et al. | 347/86 |
| 8,075,088 | B2 | 12/2011 | Kawashima et al. | |
| 2009/0141094 | A1* | 6/2009 | Kubo et al. | 347/85 |
| 2011/0025789 | A1* | 2/2011 | Kuwata et al. | 347/86 |
| 2011/0050814 | A1 | 3/2011 | Tsubaki et al. | |
| 2011/0063385 | A1 | 3/2011 | Watanabe | |
| 2011/0181670 | A1 | 7/2011 | Tsubaki | |
| 2012/0050425 | A1 | 3/2012 | Watanabe | |
| 2012/0062659 | A1 | 3/2012 | Tsubaki | |

FOREIGN PATENT DOCUMENTS

| | | | |
|---|---|---|---|
| JP | 2004167839 | A * | 6/2004 |
| JP | 2004-330683 | | 11/2004 |
| JP | 2005-262879 | | 9/2005 |
| JP | 2008-229970 | | 10/2008 |
| JP | 2008-254187 | | 10/2008 |
| JP | 2009-113212 | | 5/2009 |
| JP | 2009-285900 | | 12/2009 |
| JP | 2009-292010 | | 12/2009 |
| JP | 2010-131959 | | 6/2010 |
| JP | 2011-148101 | | 8/2011 |
| JP | 2011-230337 | | 11/2011 |

* cited by examiner

*Primary Examiner* — Alessandro Amari
*Assistant Examiner* — Michael Konczal
(74) *Attorney, Agent, or Firm* — Cooper & Dunham LLP

(57) ABSTRACT

An inkjet recording device including a line engine including a plurality of recording heads that are aligned in a main scanning direction, in which an arbitrary one of the plurality of recording heads is replaceable. Each of the plurality of recording heads includes a head tank attached on the corresponding one of the plurality of recording heads. The head tank includes a supply port and a discharge port for ink. The head tanks that are adjacent to each other are connected by the respective discharge ports and the supply ports.

9 Claims, 12 Drawing Sheets

--Prior Art--

--Prior Art--

--Prior Art--

--Prior Art--

INKJET RECORDING DEVICE

BACKGROUND OF THE INVENTION

1. Field of the Invention

The present invention relates to an inkjet recording device provided with a line engine.

2. Description of the Related Art

As an inkjet recording device/image forming apparatus for performing recording by jetting ink droplets from a recording head, there is a line ink jet type provided with a line engine in which plural recording heads (hereinafter, also simply referred to as "heads") are aligned in a main scanning direction. As such a line engine configuration, there is known a configuration where one recording head is replaceable.

However, in a conventional inkjet recording device in which one head is replaceable in the line engine, when an arbitrary head fails or breaks, only the corresponding head needs to be replaced.

An ink supply flow path in a line engine configuration frequently includes a manifold for distributing ink to the respective heads from the sub tank. With such a configuration of the supply flow path, in order to enable the replacement of one head, the size of the device is increased, the operation of replacing a head is inefficient, and the cost of the device is increased.

Furthermore, in the conventional line engine configuration, when filling ink into a head after replacement, air bubbles are discharged not only from the replaced head; ink is discharged together with air bubbles substantially equal from other heads as well. Thus, in such a configuration, by filling ink in the head after replacement, a large amount of ink is discarded, and the operation of filling the ink in the head takes a long time.

Patent Document 1 discloses a simple configuration for discharging air bubbles stuck in a distributor, and reducing the amount of ink that becomes waste liquid flowing out together when the air bubbles are discharged. This configuration includes a distributor for distributing and supplying ink to the respective heads; an electromagnetic valve, provided in the distributor, for opening and closing an air bubble discharge opening; and a pump provided between the sub tank and the distributor. In this configuration, ink is sent to the distributor so that the air bubbles in the distributor are discharged from the air bubble discharge opening.

Furthermore, Patent Document 2 discloses a configuration for reducing the size of the head tank (referred to as "sub tank" in Patent Document 2) and increasing the discharged air bubbles in the head tank. This configuration includes a filter member provided in the head tank, which divides the head tank into an upstream chamber and a downstream chamber; a supply path configured to supply the ink from the downstream chamber of the ink storing unit to the head; and a discharge path configured to discharge the ink discharged from a discharge opening of the head to the outside.

However, both of these devices have complex configurations, and problems remain unsolved as to the size of the device is increased, the operation of in replacing a head is inefficient, and the cost of the device is increased.

Patent Document 1: Japanese Laid-Open Patent Publication No. 2010-131959

Patent Document 2: Japanese Laid-Open Patent Publication No. 2011-148101

SUMMARY OF THE INVENTION

The present invention provides an inkjet recording device, in which one or more of the above-described disadvantages are eliminated.

According to an aspect of the present invention, there is provided an inkjet recording device including a line engine including a plurality of recording heads to eject ink from nozzles, the plurality of recording heads being aligned in a main direction perpendicular to a recording medium transportation direction such that the plurality of recording heads cover a width length of a recording medium, in which an arbitrary one of the plurality of recording heads is replaceable; and an ink cartridge to retain ink to be supplied to the plurality of recording heads of the line engine, wherein each of the plurality of recording heads includes a head tank attached on the corresponding one of the plurality of recording heads to retain ink supplied from the ink cartridge and to supply ink to the corresponding one of the plurality of recording heads, and each of a plurality of the head tanks includes a supply port to receive ink supplied from the ink cartridge, a discharge port to discharge ink flown through the plurality of recording heads, and a plurality of ink flow paths provided to each of the supply ports and the discharge ports of the plurality of the head tanks to connect the respective discharge ports and the supply ports of the head tanks that are adjacent to each other such that the plurality of the head tanks are connected in series by the plurality of ink flow paths.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

Before describing an embodiment of the present invention, a description is given of an ink supply system in a conventional line engine with reference to FIGS. 16A through 18.

Figure 16A:
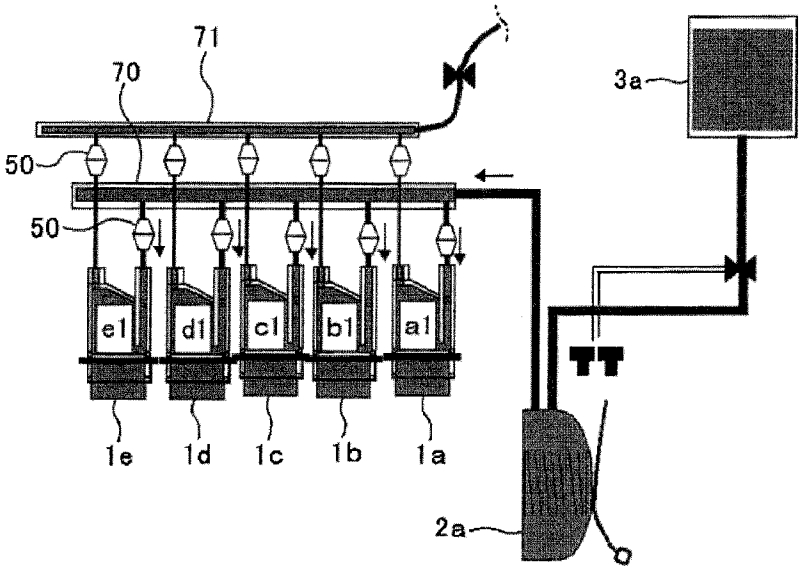
FIGS. 16A and 16B illustrate an ink supply system of a conventional configuration.

As shown in FIG. 16A, recording heads (jetting heads) 1*a*, 1*b*, 1*c*, 1*d*, is are provided with head tanks a1, b1, c1, d1, e1, respectively. Above the head modules constituted by the heads and the head tanks, a supply manifold 70 and a waste liquid manifold 71 are provided. The manifolds 70, 71 and the head tanks a1, b1, c1, d1, e1 are connected by supply flow paths such as tubes. As shown in a side view of FIG. 16B, the head modules are aligned in one row in the main scanning direction (direction orthogonal to the sheet conveying direction), constituting a line head. In a line engine configuration in which plural heads (five in the example of FIG. 16A) are aligned in the main scanning direction, couplings 50 are provided in the supply flow paths so that one of the heads (an arbitrary head) can be replaced. Thus, even when there is ink in the flow path, the flow path can be separated. As a matter of simplification, only the couplings on the left edge are denoted by a reference numeral 50, among the couplings provided in the flow paths connecting the manifolds 70, 71 and the head tanks a1, b1, c1, d1, e1.

In this conventional configuration, the manifolds 70, 71 are not disposed in an upper direction from the head tanks a1, b1, c1, d1, e1 (the manifolds 70, 71 are not positioned above the head tanks), in order to avoid interference between the head and the manifolds when attaching and detaching the head to replace one head. In this configuration, the space is large in the width direction (sheet conveying direction) including the supply system and head module (head and head tank). Therefore, there is a problem in terms of space-saving.

Figure 16B:
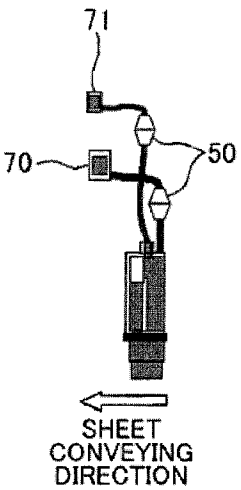
Figure 17:
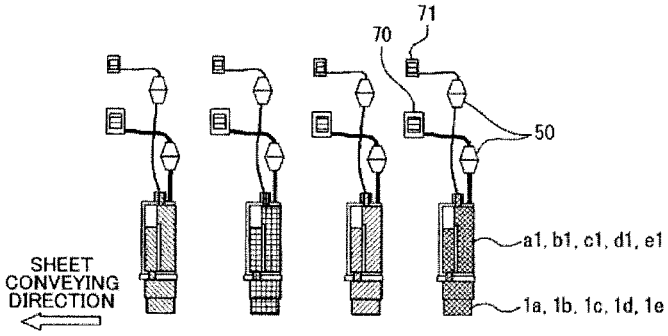
FIG. 17 illustrates the overall size of a head part of a conventional configuration.

FIGS. 16A and 16B only illustrate one line (one row). However, a color inkjet recording device typically has a line configuration including plural rows. Therefore, the overall size of the head unit is large. Accordingly, as shown in FIG. 17, in a supply system of a total of four colors, there are four rows of lines of the respective colors aligned in the sheet conveying direction. In the sheet conveying direction, the rows are arranged as a head row, a manifold row, a head row, a manifold row, and so forth. Thus, the overall size of the head unit in the sheet conveying direction including the ink supply system and the head modules is large.

Figure 18:
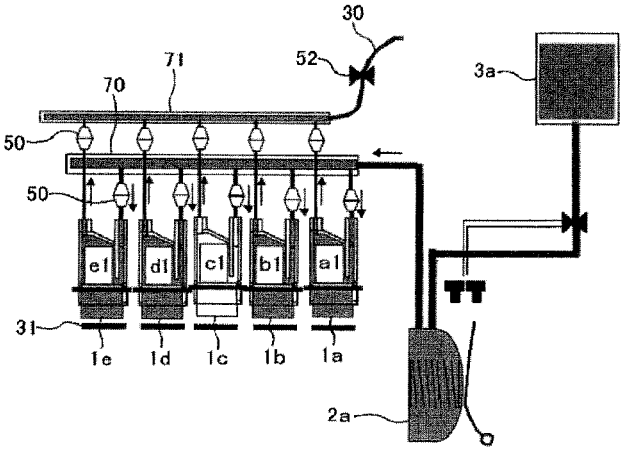
FIG. 18 illustrates a state where ink is filled in the head after replacing the head, in a conventional configuration.

FIG. 18 illustrates a state where ink is filled in the head after replacing the head, in the configuration of FIGS. 16A through 17. FIG. 18 illustrates a case where a head module (referred to as "module c") constituted by the head 1*c* and the head tank c1 is replaced.

After filling the head with ink after replacing the module c, the recording heads 1*a*, 1*b*, 1*d*, 1*e* and the head tanks a1, b1, d1, e1 that have not been replaced, are filled with ink, and the head 1*c* and the head tank c1 that have been replaced are not filed with ink.

When the head 1*c* and the head tank c1 are filled with ink in this state, pressure is applied to an ink cartridge 3*a* and ink inside the ink cartridge 3*a* is sent into a sub tank 2*a*. The ink is sent from the sub tank 2*a* to the supply manifold 70, and ink is supplied to each head tank. At this time, a waste liquid valve (opening-closing value) 52 provided in a waste liquid flow path 30 connected to the waste liquid manifold 71 is in an open state, and ink or air bubbles are discharged from the respective head tanks through the waste liquid manifold 71 to the waste liquid flow path 30.

In a conventional supply system including a manifold, the ink is not only supplied to the replaced head 1*c* and head tank c1, but also to the other heads 1*a*, 1*b*, 1*d*, 1*e* and the other head tanks a1, b1, d1, e1. Therefore, until the replaced head and head tank are filled with ink, a large amount of ink is wastefully discharged from the other heads.

Furthermore, when the air bubbles inside the head tank c1 are discharged through the waste liquid manifold 71, at the same time, ink is discharged from the other head tanks a1, b1, d1, e1, and therefore a large amount of ink is wastefully discarded.

Suction caps 31 are provided at the nozzle parts of the heads 1*a*, 1*b*, 1*c*, 1*d*, 1*e*, and the suction caps 31 receive and suction the ink that has dripped down from the nozzles when the heads are filled with ink.

As described above, in a conventional configuration, the size of the entire recording head unit is large, and a large amount of ink is wastefully discharged and discarded when filling a head with ink after replacing the head.

A description is given, with reference to the accompanying drawings, of embodiments of the present invention. Elements corresponding to those of the conventional configuration described with reference to FIGS. 16A through 18 are denoted by the same reference numerals.

Figure 1:
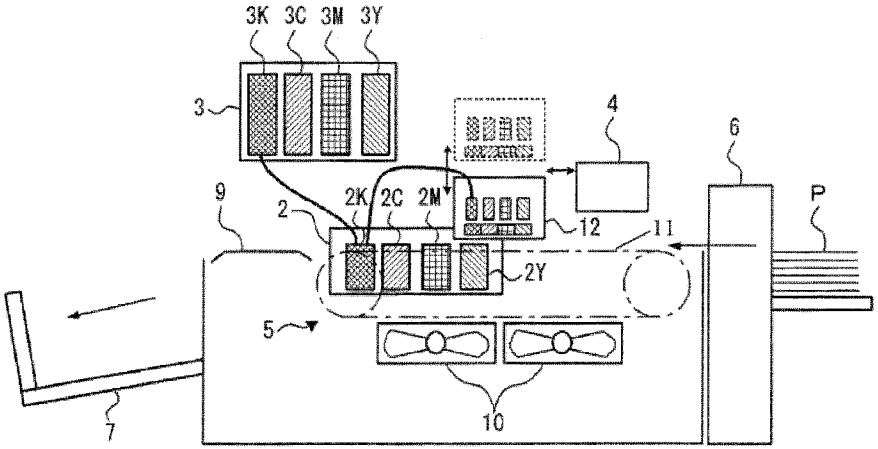
FIG. 1 illustrates a schematic configuration of an example of a line type inkjet image forming apparatus according to an embodiment of the present invention.

FIG. 1 illustrates a schematic configuration of an example of a line type inkjet image forming apparatus according to an embodiment of the present invention. This inkjet image forming apparatus is a line inkjet type image forming apparatus in which heads for jetting liquid droplets from nozzles are constituting a line configuration across substantially the entire width of a recording medium.

In FIG. 1, a reference numeral 12 denotes a head unit on which a line engine having a line configuration of plural rows (four rows in this example) is mounted. The head unit 12 is disposed above a conveying unit 5. The conveying unit 5 causes a conveying belt 11 to suction a sheet P fed from a sheet feeding unit 6, and conveys the sheet P from the right to the left direction as indicated by an arrow in FIG. 1. On the front surface of the sheet P conveyed by the conveying unit 5, ink droplets are jet from a recording head (a recording head is described with reference to FIG. 2 and onward) to record an image.

The conveying belt 11 of the conveying unit 5 has holes, so that by suctioning air with suction fans 10 provided below the conveying unit 5, the sheet is conveyed while its back surface is suctioned on the conveying belt 11. The sheet P on which an image has been recorded by the head unit 12 is passed over a guide plate 9 and is discharged to and stacked on a sheet eject tray 7. A cleaning unit 9 is provided adjacent to the head unit 12.

In the configuration of the ink supply system, from ink cartridges of respective colors 3K, 3C, 3M, 3Y set in an ink cartridge unit 3, ink of respective colors (K: black, C: cyan, M: magenta, and Y: yellow, the four colors are expressed in the figure by different fill patterns) is first sent to the sub tanks of the respective colors 2K, 2C, 2M, 2Y disposed in a sub tank unit 2, and is then supplied to the recording heads of the respective lines. In FIG. 1, as a matter of simplification, a supply flow path (supply tube, etc.) connecting the ink cartridge 3K→the sub tank 2K→the recording head is only indicated for black K; however, also for each of the other three colors (C, M, Y), there is a similar supply flow path connecting the ink cartridge→the sub tank→the recording head.

The sub tanks 2K, 2C, 2M, 2Y have a spring provided inside, and a flexible film is adhered to one side of the sub tank to press the internal spring. A natural supply method is implemented by forming negative pressure in the head according to the return pressure of the spring.

The method of cleaning a recording head is performed as follows. First, the head unit 12 is withdrawn upward as indicated by dashed lines in FIG. 1, and the cleaning unit 4 enters into the space formed between the conveying unit 5 and the head unit 12. Next, the head unit 12 moves down and sits on the cleaning unit 4, and the recording head is cleaned by suctioning the ink inside the head by a pump suction unit (not shown). When the cleaning is completed, the head unit 12 is withdrawn upward again, and the cleaning unit 4 returns to the position indicated in FIG. 1. Then, the head unit 12 moves down to a predetermined position on the sheet conveying surface of the conveying unit 5, so that recording becomes possible.

Figure 2:
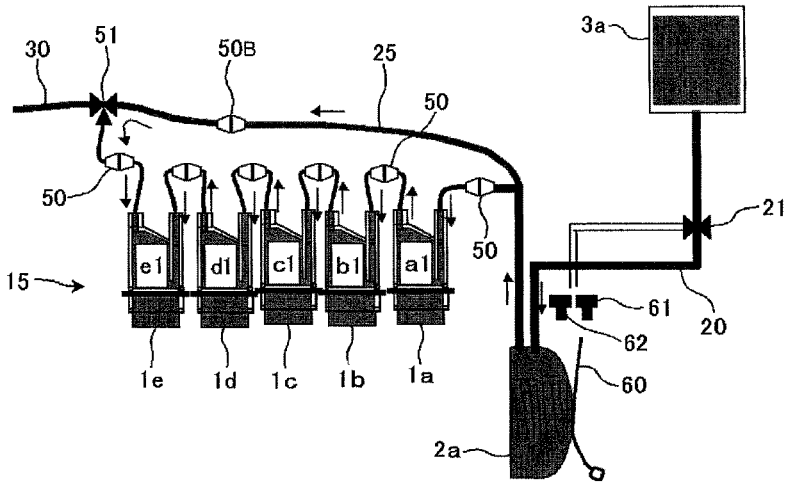
FIG. 2 illustrates a configuration of an ink supply system of the image forming apparatus shown in FIG. 1.

FIG. 2 illustrates a configuration of an ink supply system according to the present embodiment. The configurations of the line heads of four lines (four rows) and the ink supply system for supplying ink to the lines in the present embodiment are all the same. FIG. 2 only illustrates one line among the four lines (four rows). Furthermore, the description is given without distinguishing the colors, and therefore the reference numerals used are 3*a* for the ink cartridge, 2*a* for the sub tank, and 15 for the line head.

As illustrated in FIG. 2, the line head 15 of one line is constituted by five recording heads 1*a*, 1*b*, 1*c*, 1*d*, 1*e* in the present example. The recording heads (jetting heads) 1*a*, 1*b*, 1*c*, 1*d*, 1*e* are respectively provided with head tanks a1, b1, c1, d1, e1. A head module is constituted by a head and a head tank. When replacing a head, the head module is replaced. Plural head modules are aligned in one row in the main scanning direction (direction orthogonal to sheet conveying direction), constituting the line head 15.

Figure 3:
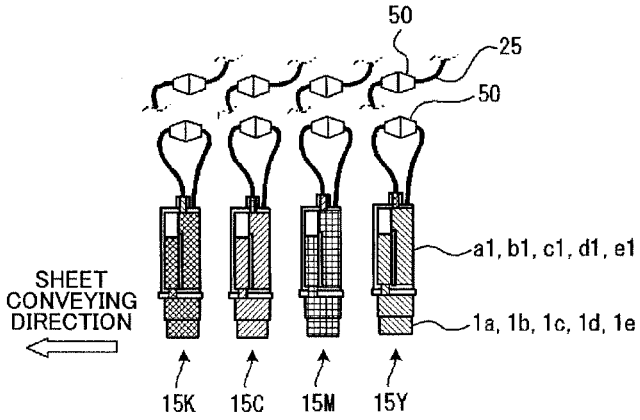
FIG. 3 illustrates an ink supply system of four colors as viewed from the main scanning direction.

FIG. 3 illustrates four lines (four rows) of line heads 15K, 15C, 15M, 15Y as viewed from the main scanning direction (direction orthogonal to the sheet conveying direction). Five recording heads 1*a*, 1*b*, 1*c*, 1*d*, 1*e* and head tanks a1, b1, c1, d1, e1 are aligned in a row in the main scanning direction constituting one line of the line head 15. Furthermore, four line heads 15 (15K, 15C, 15M, 15Y) are aligned in the sub scanning direction (sheet conveying direction), constituting a head part.

Referring back to FIG. 2, the ink cartridge 3*a* is connected to the sub tank 2*a* by a supply flow path 20. Furthermore, the sub tank 2*a* is connected to the head tank a1 of the most upstream head module by the supply flow path 20. In the supply flow path 20 between the ink cartridge 3*a* and the sub tank 2*a*, there is provided an ink supply valve (open close valve) 21. Furthermore, in the supply flow path 20 between the sub tank 2*a* and the head tank 1*a*, there is provided a coupling 50 (for separating (cutting apart) the supply flow path) used when replacing the head. Furthermore, the respective head modules are connected in series by a supply flow path (no reference numeral). The couplings 50 are also provided in the supply flow paths between the respective head modules.

Furthermore, there is provided a bypass supply flow path 25 that bypasses the head modules (line head). In the middle of the bypass supply flow path 25, there is provided a coupling 50B (the coupling 50B is the same as other couplings 50; however, for describing the head replacement below, the reference numeral is accompanied by a letter B). The upstream side of the bypass supply flow path 25 is connected to the sub tank 2*a*, and the downstream side of the bypass supply flow path 25 is connected to the waste liquid flow path 30 and the head tank e1 of the most downstream head module via a three-way valve 51. In a supply flow path between the head tank e1 and the three-way valve 51, there is also provided the coupling 50. In FIG. 2, a reference numeral 60 denotes a sensor filler, a reference numeral 61 denotes an ink full detection sensor, and a reference numeral 62 denotes an ink empty detection sensor.

The configuration of a head module is described below with reference to FIG. 7. The recording heads 1*a*, 1*b*, 1*c*, 1*d*, 1*e* are respectively provided with the head tanks a1, b1, c1, d1, e1 for accommodating ink. Above the head tanks, a supply port 100 and a discharge port 101 are provided (see FIG. 4). As illustrated in FIG. 2, the head tanks that are adjacent to each other are connected at their respective discharge ports and supply ports. Accordingly, plural recording heads are connected in series.

The supply flow path connecting the sub tank 2*a* and the supply port 100 of the most upstream head tank a1 is a first ink supply flow path. The supply flow path (bypass supply flow path 25) connecting the sub tank 2*a* and the discharge port 101 of the most downstream head tank e1 is a second ink supply flow path. Furthermore, the waste liquid flow path 30 is connected to the second ink supply flow path (bypass supply flow path 25) via a three-way switching valve (three-way valve) 51.

As described above, in an embodiment of the present embodiment, the ink supply system includes a serial connection of the recording heads (head modules) in series, and a bypass supply flow path bypassing the line head. The ink inside the ink cartridge 3*a* is first supplied to the most upstream head tank a1 via the sub tank 2*a* by the supply flow path 20, and is then sequentially supplied to the head tanks b1, c1, d1, e1 that are connected in series, in the stated order. The more the downstream side, the larger the pressure loss of ink supply, and therefore the bypass supply flow path 25 is connected to the most downstream head tank e1 to implement a function of assisting ink supply.

The coupling 50 (50B) can block the flow path when the flow path is separated. Even when the flow path is filled with ink, the coupling 50 can be separated. The head (head module) can be replaced after the flow path is separated (cut apart).

At least the ink flow path (supply flow path) from the coupling 50 provided between the sub tank 2*a* and the most upstream head tank at and the coupling 50 provided between the most downstream head tank e1 and the three-way valve 51, i.e., the ink flow path between connected heads (head modules), is made of a non-rigid material such as a tube. Furthermore, connection means (couplings 50) are provided so that each head (head module) can be connected to and cut off from the ink flow path and each head can be replaced. As this connection means, an appropriate constitution may be applied.

FIG. 2 illustrates a state where the supply flow path, the recording heads, and the sub tank are filled with ink. As described above, the ink is sent from the ink cartridge 3*a* to the sub tank 2*a*, from the sub tank 2*a* to the most upstream head tank a1, and is then sequentially supplied to the downstream head tanks b1, c1, d1, e1 in the stated order.

In case it is necessary to replace a recording head, the couplings 50 attached to the flow path between heads (head modules) are separated (cut apart), so that only the target head (head module) can be replaced.

In a regular ink supply operation, the ink amount in the sub tank 2*a* is controlled to be an appropriate amount by amplifying the swell of the film surface of the sub tank 2*a* with the sensor filler 60, and detecting the amplitude of the sensor filler 60 with the ink empty detection sensor 62 and the ink full detection sensor 61.

When the ink empty detection sensor 62 detects the filler, the ink supply valve 21 is opened and ink is supplied from the ink cartridge 3*a*. When the ink full detection sensor 61 detects the filler, the ink supply valve 21 is closed and the ink supply is stopped.

As shown in FIG. 2, the configuration of present embodiment does not include a supply manifold or a waste liquid manifold as in a conventional configuration. Thus, the configuration of the head part can be simplified and reduced in size. Furthermore, because there is no supply manifold or waste liquid manifold, the number of couplings 50 is small. Therefore, the number of components is reduced and costs are reduced compared to the conventional manifold configuration.

FIG. 3 illustrates the supply system of all four colors viewed from the main scanning direction (direction orthogonal to the sheet conveying direction).

As shown in FIG. 3, the supply system of all four colors has line heads 15 of the respective colors aligned in four rows in the sheet conveying direction. The present embodiment does not include a supply manifold or a waste liquid manifold. Thus, when replacing a head, there are no interfering components when pulling out the head module upwards. Accordingly, the line heads of the respective colors can be disposed closer to each other compared to the case of a conventional device having a manifold configuration. Therefore, the space (size in sheet conveying direction) of the entire head part can be reduced.

Figure 4:
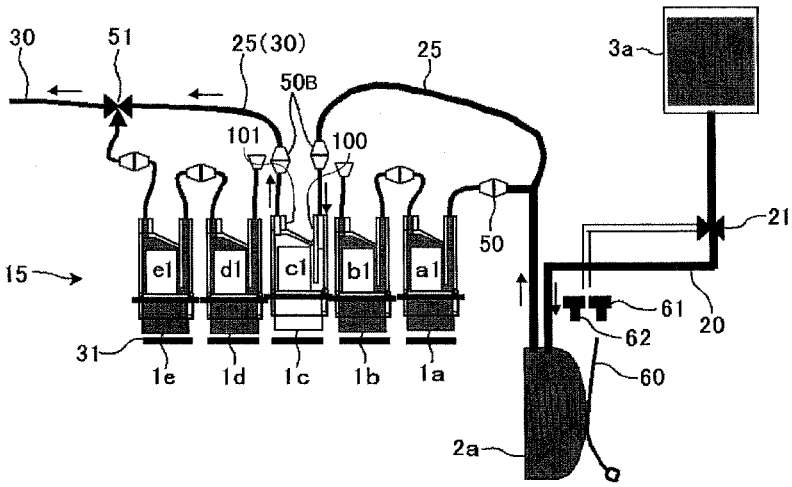
FIG. 4 illustrates a connection state of flow paths when filling the head with ink after the head is replaced.

FIG. 4 illustrates a connection state of flow paths when filling the head with ink after the head is replaced. In this example, the center head module C (head module C constituted by the head 1*c* and the head tank c1) is replaced among the plural head modules (five in this example) aligned in the main scanning direction. However, the same applies to a case where other head modules are replaced.

FIG. 4 illustrates a state where a new head module C is set at a predetermined position in the line head 15, and neither the head 1*c* nor the head tank c1 is filled with ink. When the head module is replaced, the coupling 50B of the bypass supply flow path 25 is separated and connected to a coupling of the replacement head module.

The upstream side (sub tank 2*a* side) of the bypass supply flow path 25 that has been separated (cut apart) is connected with the supply port 100 of the head tank c1, and the downstream side (waste liquid flow path 30 side) of the bypass supply flow path 25 is connected with the discharge port 101 of the head tank c1.

The three-way valve 51 is attached between the bypass supply flow path 25 and the waste liquid flow path 30. As shown in FIG. 2, in a regular ink supply operation, the bypass supply flow path 25 and the head tank e1 are connected. When the replacement head is being filled with ink (the state of FIG. 7), the bypass supply flow path 25 and the waste liquid flow path 30 are connected.

When filling the head 1*c* and the head tank c1 with ink, the ink supply valve 21 is opened while pressure is being applied to the ink cartridge 3*a* with a pressurizing device (not shown). Accordingly, the ink inside the ink cartridge 3*a* is sent to the sub tank 2*a*, and when the sub tank 2*a* becomes full, the ink is supplied to the head 1*c* and the head tank c1.

At this time, the ink supplied from the sub tank 2*a* is slightly supplied to the head 1*a* as well. However, the inside of the replaced head 1*c* and head tank c1 is open to the atmosphere via the three-way valve 51 and the waste liquid flow path 30. Therefore, most of the ink is supplied to the head tank c1.

When ink has been supplied from the sub tank 2*a* for a predetermined time period, the ink supply valve 21 is closed and ink supply is stopped. After filling the head tank c1 with ink, the couplings 50 in the supply flow path of the head tank c1 are connected as illustrated in FIG. 2, so that a regular printing state is attained.

When filling the head with ink, the ink that drips down from the nozzles of the heads 1*a*, 1*b*, 1*c*, is received and suctioned by the suction caps 31 (see FIG. 4) that are placed below the nozzles of the heads. Furthermore, in order to fill every corner of the liquid chamber inside each of the heads 1*a*, 1*b*, 1*c*, 1*d*, 1*e*, the ink is suctioned from the head nozzles with the suction caps 31.

Figure 5:
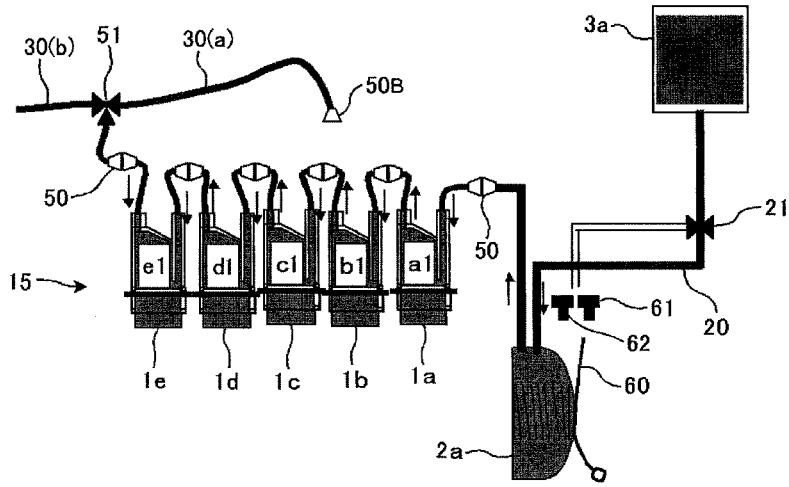
FIG. 5 illustrates an ink supply system according to a second embodiment.

FIG. 5 illustrates an ink supply system according to a second embodiment. Elements corresponding to those of the ink supply system according to the first embodiment described with reference to FIGS. 2 through 4 are denoted by the same reference numerals and are not further described. Only the different parts are described.

The second embodiment illustrated in FIG. 5 is different from the first embodiment in that there is no bypass supply flow path 25 connecting the sub tank 2*a* and the head tank e1.

Because there is no bypass supply flow path, in order to compensate for the pressure loss when ink is supplied to the head 1*e* on the downstream side, the inner diameter of the supply flow path connecting the head tanks is larger than that of the first embodiment to reduce the loss.

Furthermore, as shown in FIG. 5, the most downstream head module (1*e*, e1) is connected to the waste liquid flow path 30 via the three-way valve 51. A coupling 50 is attached to the end of one side 30 (*a*) of the waste liquid flow path 30, which is provided in a free state so that the waste liquid flow path 30 can be connected to any of the couplings of the heads.

In FIG. 5, the three-way valve 51 is in a state where the flow path on the head tank e1 side is connected, and the discharge side 30 (*b*) of the waste liquid flow path 30 is blocked. Furthermore, the supply flow path, the head, and the head tank are filled with ink. This is a state where regular printing can be performed.

The ink is sent from the ink cartridge 3*a* to the sub tank 2*a*, from the sub tank 2*a* to the most upstream head 1*a*, and is then sequentially supplied to the downstream heads 1*b*, 1*c*, 1*d*, 1*e* in the stated order.

A supply flow path connects adjacent heads, and a coupling 50 is attached to this supply flow path, similar to the case of the first embodiment. The coupling 50 can separate (can attach/detach) the supply flow path in a state where the supply flow path is filled with ink.

In the above configuration, a smaller number of couplings 50 can be used compared to the case of the first embodiment, and therefore component costs can be further reduced.

Figure 6:
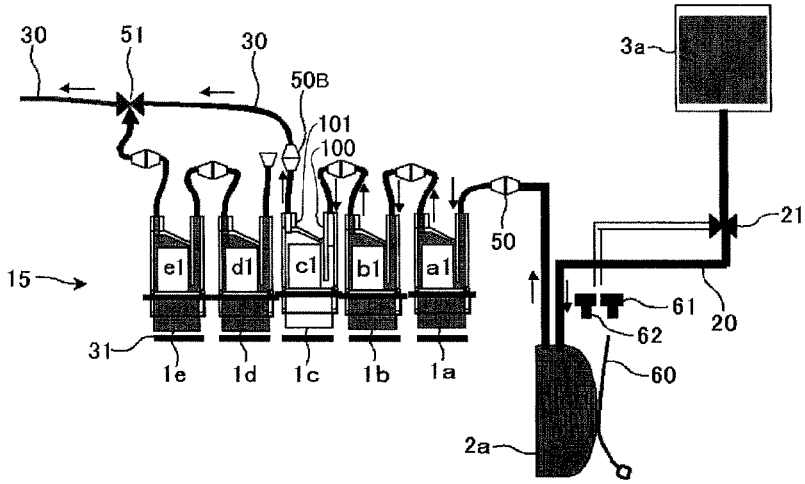
FIG. 6 illustrates a connection state when filling the head with ink after replacing the head in the ink supply system according to the second embodiment.

FIG. 6 illustrates the connection state when filling the head with ink after replacing the head in the ink supply system according to the second embodiment. In this example, the center head module C (head module C constituted by the head 1*c* and the head tank c1) is replaced. However, the same applies to cases where other head modules are replaced.

FIG. 6 illustrates a state where a new head module C is set at a predetermined position in the line head 15, and neither the head it nor the head tank c1 is filled with ink. When the head module is replaced, the supply port 100 of the head tank c1 is connected to the coupling of the head tank b1 on the upstream side, and the discharge port 101 of the head tank c1 is connected to the coupling 50B attached to one end of the waste liquid flow path 30. The three-way valve 51 is in a state where the head tank c1 and the waste liquid flow path 30 are open to the atmosphere.

When filling the head 1*c* and the head tank c1 with ink, the ink supply valve 21 is open while applying pressure to the ink cartridge 3*a* with a pressurizing device (not shown) similar to the first embodiment. Accordingly, the ink inside the ink cartridge 3*a* is sent to the sub tank 2*a*, and when the sub tank 2*a* becomes full, the ink is supplied to the head tank a1.

The ink is sequentially supplied to the head tanks a1→b1→c1 in the stated order. As the discharge port 101 of the head tank c1 is open to the atmosphere via the waste liquid flow path 30, when ink is sent into the head tank c1, the air bubbles inside the head tank c1 are discharged outside the device via the waste liquid flow path 30, so that it is easy to fill the head tank c1 with ink.

When ink is supplied from the sub tank 2*a* for a predetermined time period, the ink supply valve 21 is closed and ink supply is stopped.

After filling the head with ink, the coupling of the supply flow path of the head tank c1 is connected in a state as illustrated in FIG. 5, so that a regular printing state is attained.

When filling the head with ink, as for the ink that has dripped down from the nozzles of the heads 1*a*, 1*b*, 1*c*, the suction caps 31 disposed below the nozzles of the heads receive and suction this ink. Furthermore, in order to fill every corner of the liquid chamber inside the heads, the ink is suctioned from the head nozzles with the suction caps 31.

Figure 7B:
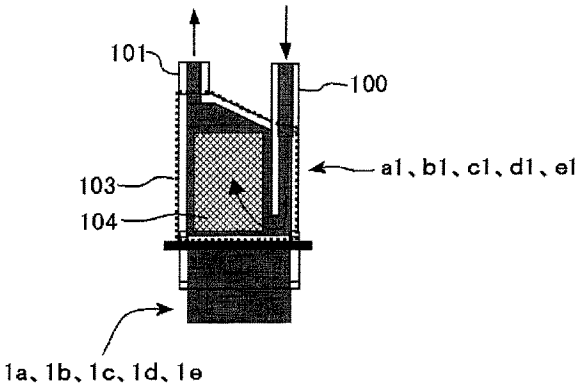
FIGS. 7A and 7B are detailed diagrams of the inside configuration of a head tank.
Figure 7A:
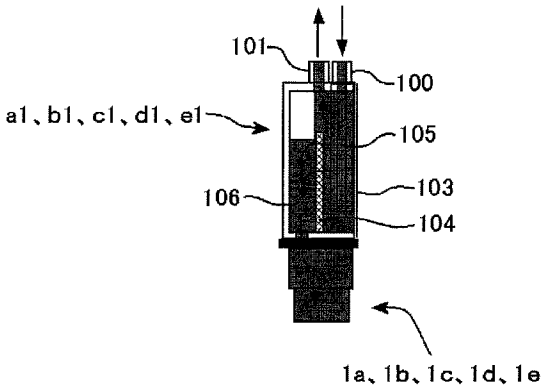

FIGS. 7A and 7B are detailed diagrams of the inside configuration of the head tank. FIG. 7A is a view from the main scanning direction, and FIG. 7B is a view from the sub scanning direction.

The head tank is mainly constituted by the supply port 100, the discharge port 101, a filter 104, and a film 103. As viewed from the main scanning direction, the inside of the head tank is mainly divided into right and left liquid chambers 105, 106, and the filter 104 is disposed between the left and right liquid chambers 105, 106.

The liquid chamber 105 on the right side is on the upstream side of the filter 104 in the ink flow, and the liquid chamber 106 on the left side is on the downstream side of the filter 104 in the ink flow. The ink passes through the filter 104 when moving from the upstream liquid chamber 105 to the downstream liquid chamber 106.

The ink that has moved to the liquid chamber 106 on the downstream side of the filter 104 is sent to the heads 1*a*, 1*b*, 1*c*, 1*d*, 1*e*.

Furthermore, the ink that has entered the liquid chamber 105 on the upstream side of the filter 104 of the head tank from the supply port 100, is divided into ink that passes through the filter 104 as described above and ink that is sent to the discharge port 101. The ink that is sent to the discharge port 101 is sent to an adjacent head on the downstream side.

The ink flow is connected by the liquid chamber 105 on the upstream side of the filter 104 inside the head tank, and therefore the ink can be supplied to the next head by minimizing the flow path resistance.

The flexible film 103 is adhered to one side of the liquid chamber 105 on the upstream side of the filter 104 of the head tank a1, b1, c1, d1, e1. This provides the liquid chamber 105 with a function of adsorbing the variation in the pressure caused by ON/OFF of the ink flow (a damper function of adsorbing the variation in the pressure).

Accordingly, in an embodiment of the present invention, heads (head tanks) adjacent to each other in a line engine are connected by a flow path, and therefore there is no need for a large component having a function of distributing the ink such as a manifold. Thus, the entire device can be reduced in size and space-saving is possible.

In addition to the fact that a manifold is unnecessary, it is possible to reduce the number of connection means (coupling) required for separating (cutting apart) the supply flow path connecting the manifold and the heads. Therefore, the costs of components can be reduced.

Furthermore, there is no need to place a large manifold above the heads, and therefore the accessibility to the head part is improved, thus facilitating the operations when replacing a single head, such as retrieving and attaching the head.

Furthermore, it is possible to form (connect) a liquid discharge flow path for discharging ink waste liquid and air bubbles only from the replaced head, and the air inside the replaced head can be directly discharged to the waste liquid flow path. Therefore, air can be easily discharged from the entire flow path without sending the air inside the replaced head to a head disposed on the downstream side (a head that is not replaced), thus reducing the time taken to fill the head with ink.

Additionally, an air bubble discharge path is connected only from the replaced head, and therefore there is no need to discharge air bubbles or ink from a head that is not replaced and that is filled with ink. Thus, it is possible to reduce the amount of ink that is wastefully discharged when filling a head with ink.

Furthermore, the head tank includes a first liquid chamber and a second liquid chamber with a filter provided therebetween. A supply port and a discharge port are provided so as to be connected by the first liquid chamber, and the recording head is connected to the second liquid chamber. Therefore, in a configuration where plural recording heads are connected in series, the ink can be supplied to the next head (head tank) by minimizing the flow path resistance.

Incidentally, when the flow path joint (coupling 50) is separated when replacing a head, ink may leak out from the separated flow path joint. Conventionally, when replacing a head, there is a method of preventing the leakage of ink by separating the joint or coupling after discharging the ink inside the head. However, it is time consuming to completely remove the ink inside the head, and it is difficult to completely remove the ink within a short period of time. If the joint or coupling is separated when the ink is not completely removed, ink will leak from the separated joint or coupling.

In a second embodiment of the present invention described below, the flow path joint (coupling 50) is separated while the negative pressure inside the ink supply path is greater than the negative pressure during regular printing, so that ink is prevented from leaking or dripping when replacing a head.

Figure 8:
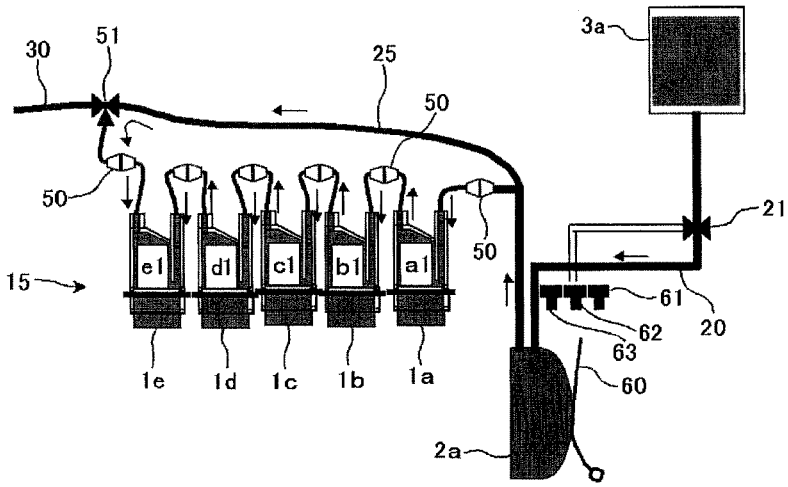
FIG. 8 illustrates a configuration of an ink supply system according to the second embodiment.

FIG. 8 illustrates a configuration of an ink supply system according to a second embodiment. Other than the ink supply system, the image forming apparatus is the same as that of the first embodiment described with reference to FIGS. 1 through 7, and therefore overlapping descriptions are omitted and only the different parts are described.

The ink supply system according to the second embodiment shown in FIG. 8 is different from the ink supply system of FIG. 2 in that the bypass supply flow path 25 is not provided with the coupling 50B, and the sub tank 2*a* is provided with an ink lower limit sensor 63, in addition to the ink full detection sensor 61 and the ink empty detection sensor 62. The ink lower limit sensor 63 is set to detect an even lower level of ink (an even smaller amount of ink) than the ink empty detection sensor 62.

A mechanism for forming negative pressure in the supply flow path is provided inside the sub tank 2*a*. The ink amount in the sub tank 2*a* is detected and maintained at a fixed level to control the negative pressure to be in a predetermined range. This point is the same as the first embodiment.

Furthermore, when the ink empty detection sensor 62 detects the sensor filler 60, the ink supply valve 21 is opened and ink is supplied from the ink cartridge 3*a*. When the ink full detection sensor 61 detects the sensor filler 60, the ink supply valve 21 is closed and ink supply is stopped. This point is also the same as the first embodiment.

Figure 9:
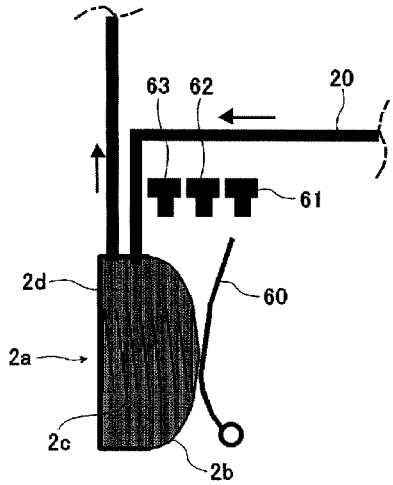
FIG. 9 is for describing a method of detecting ink in a sub tank and a method of forming negative pressure in a supply flow path.
Figure 10:
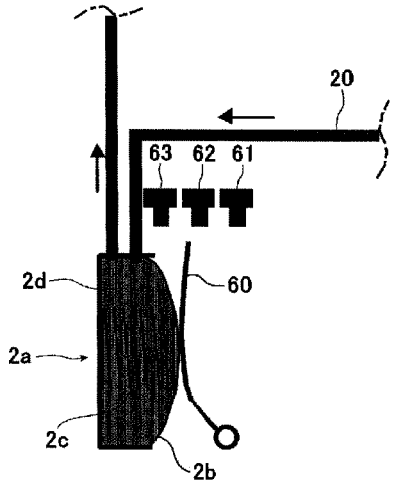
FIG. 10 is for describing a method of detecting ink in a sub tank and a method of forming negative pressure in a supply flow path.

A description is given of a method of detecting ink inside the sub tank 2*a* and a method of forming negative pressure inside the supply flow path, with reference to FIGS. 9 and 10.

In this example, the sub tank 2*a* is formed by placing a compression spring 2*c* is placed inside a sub tank case 2*d* that is substantially box-shaped and made of resin, and by adhering a flexible film 2*b* to one side of the sub tank case 2*d* in a manner as to press the compression spring 2*c*.

The negative pressure in the ink supply flow path is formed by a reaction force of the compression spring 2*c* that presses back the flexible film 2*b*. Thus, as the compression spring 2*c* is compressed, the negative pressure increases, and as the compression spring 2*c* is extended, the negative pressure decreases.

The detection of the ink amount in the sub tank 2*a* is performed by detecting, with the sensors 61 through 63, the movement of the leading end of the sensor filler 60 that follows the expansion/contraction of the surface of the flexible film 2*b*.

FIG. 9 illustrates a state where the ink full detection sensor 61 is detecting the leading end of the sensor filler 60. In a state where regular printing is possible, no more ink is supplied and the negative pressure in the supply flow path minimum.

FIG. 10 illustrates a state where the ink empty detection sensor 62 is detecting the leading end of the sensor filler 60. In this state, the negative pressure is maximum in a state where regular printing is possible.

In a state where regular printing is possible, the detection of the ink amount in the state of FIG. 9 and FIG. 10 is repeated, and the ink is constantly controlled to be a predetermined amount, i.e., the inside of the supply flow path is controlled to have negative pressure within a predetermined range.

Figure 11:
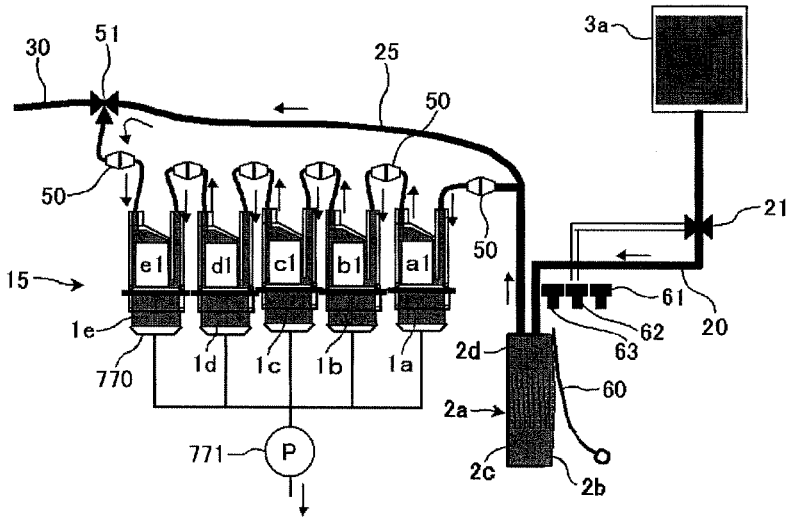
FIG. 11 illustrates the ink supply system when replacing a head.

FIG. 11 illustrates the ink supply system when replacing a head.

When replacing a head, the ink inside the head is discharged to increase the negative pressure in the supply flow path. The discharging of the ink is performed by suctioning the ink with a suction pump 771 in a state where the recording heads 1*a*, 1*b*, 1*c*, 1*d*, 1*e* are capped with a suction cap 770.

The suction cap 770 and the suction pump 771 are typically provided in an inkjet recording device as a maintenance recovery mechanism. In the device of FIG. 1, as described above regarding the cleaning method of the recording head, the cleaning unit 4 has caps. The pump suction unit may be disposed at an appropriate location.

By suctioning the ink, the ink inside the sub tank 2*a* is reduced, and the flexible film 2*b* and the spring 2*c* are deflated (become flat). The suctioning of ink is stopped when the amount of ink corresponds to the position where the ink lower limit sensor 63 of the sub tank 2*a* detects the sensor filler 60, which is even lower than the position where the ink empty detection sensor 62 of the sub tank 2*a* detects the sensor filler 60. At this time (when replacing a head), even if the ink empty detection sensor 62 detects the sensor filler 60, the ink supply valve 21 is not opened, and the ink is not supplied, and this detection is ignored.

Figure 12:
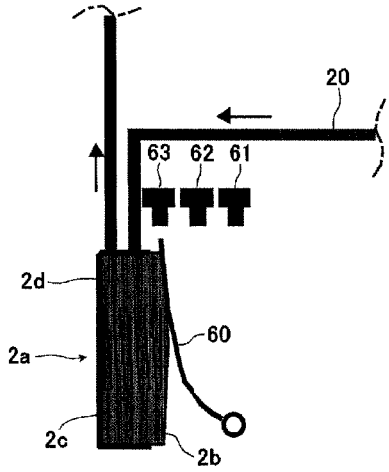
FIG. 12 illustrates the area near the sub tank when replacing a head.

FIG. 12 illustrates the area near the sub tank 2*a* when replacing a head.

As described above, the amount of ink inside the sub tank 2*a* is reduced and the surface of the flexible film 2*b* is compressed, and the leading end of the sensor filler 60 is detected by the ink lower limit sensor 63. The flexible film 2*b* and the spring 2*c* of the sub tank 2*a* are deflated, and the inside has higher negative pressure compared to the negative pressure during regular printing (FIG. 10).

Figure 13:
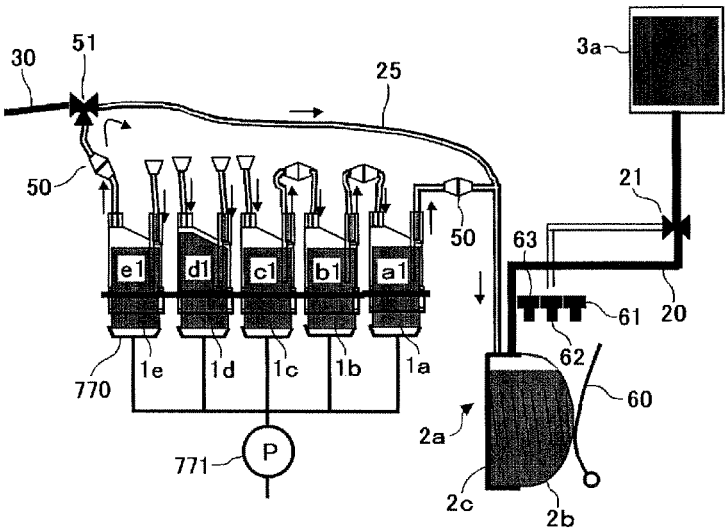
FIG. 13 illustrates the operation of replacing a head according to the second embodiment.
Figure 14:
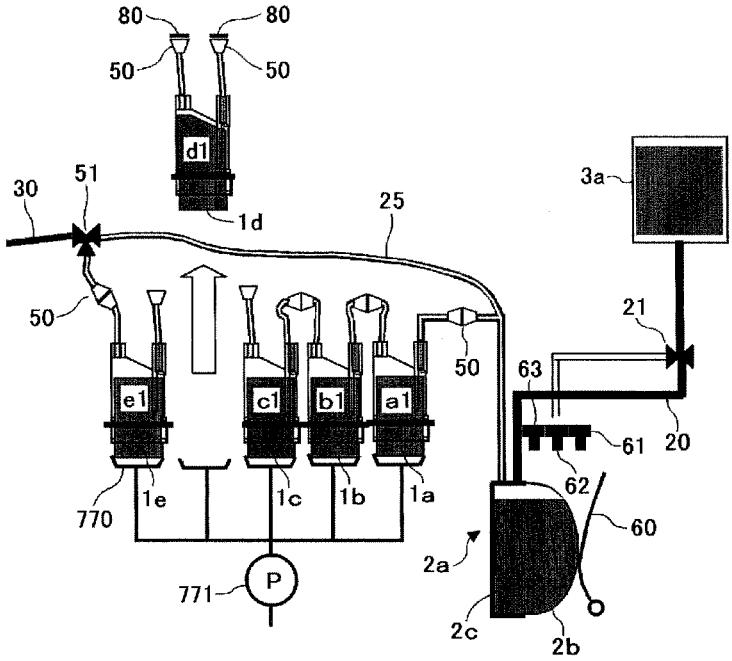
FIG. 14 illustrates the operation of replacing a head according to the second embodiment.

With reference to FIGS. 13 and 14, a description is given of replacing a head according to the second embodiment. Here, a description is given of a case of replacing the recording head 1*d* (and head tank d1).

When the coupling 50 connected to the head tank d1 of the recording head 1*d* is separated, the inside of the flow path has negative pressure, and therefore air is drawn inside. As described above, the negative pressure inside is high, and therefore the ink does not drip from the separated coupling 50, and the ink is drawn inside.

The ink in the flow paths between the head tanks a1, b1, c1, d1, e1 and inside the bypass supply flow path 25 is returned to the sub tank 2*a*. Thus, there will be no ink in the flow paths between the head tanks a1, b1, c1, d1, e1 or inside the bypass supply flow path 25.

When the flexible film 2*b* of the sub tank 2*a* is in a most expanded state, the spring 2*c* inside is extended, and the inside has atmospheric pressure. At this time, a head is replaced while the recording heads 1*a*, 1*b*, 1*c*, 1*d*, 1*e* are capped with suction caps 770. Therefore, even when the inside is in an atmospheric pressure state, ink does not drip down from the recording heads.

As shown in FIG. 14, when removing the recording head 1*d* (and head tank d1), the inside of the recording head 1*d* and the head tank d1 is in an atmospheric pressure state, and there is ink remaining inside. Therefore, when the recording head 1*d* (and head tank d1) are removed, ink may drop from the head. Therefore, a joint cover 80 is attached to the coupling 50. The removed recording head 1*d* (and head tank d1) is replaced with a new head (and head tank) (not shown), and the couplings 50 are connected, and then an ink filling procedure is performed, so that printing becomes possible.

Figure 15:
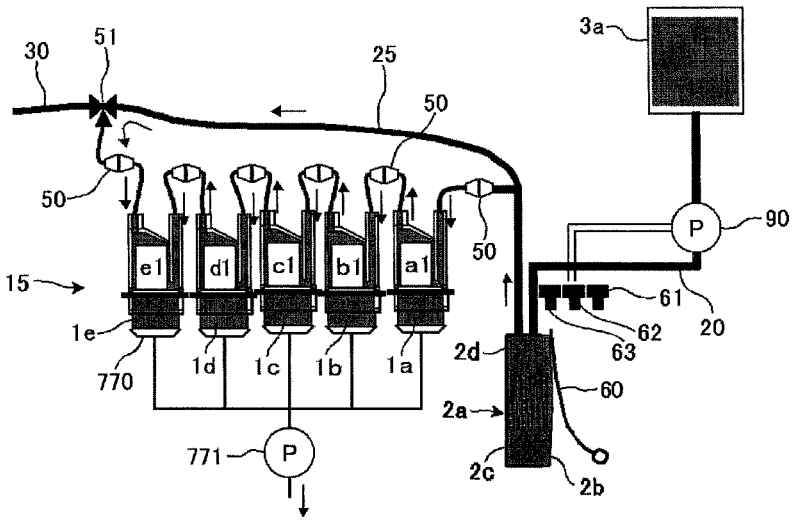
FIG. 15 illustrates an embodiment in which a different method of forming negative pressure in the ink supply flow path is performed.

Next, a description is given of an embodiment in which a different method of forming negative pressure in the ink supply flow path is performed, with reference to FIG. 15.

In the configuration described above with reference to FIGS. 8 through 14, the method of forming negative pressure in the ink supply flow path is performed by suctioning ink from the recording head (with the pump 771). Meanwhile, in the configuration described with reference to FIG. 15, a pump (tube pump 90) provided between the ink cartridge 3*a* and the sub tank 2*a* is reverse-rotated to form negative pressure. Comparing these two embodiments from the viewpoint of the ink supply method, in the first embodiment, ink is supplied from the ink cartridge 3*a* to the sub tank 2*a* by applying pressurizing air to the ink cartridge 3*a*. Meanwhile, in the embodiment of FIG. 15, the ink is supplied by the tube pump 90 provided in the flow path.

Regular ink supply is performed by sending the ink form the ink cartridge 3*a* to the sub tank 2*a*, by normal rotation of the tube pump 90 based on detection information of the ink full detection sensor 61 and the ink empty detection sensor 62. When the ink empty detection sensor 62 makes a detection, ink is sent by normal rotation of the tube pump 90. When the ink full detection sensor 61 makes a detection, the tube pump 90 is stopped.

When replacing the head, in order to increase the negative pressure inside the sub tank 2*a*, it is necessary to reduce the ink inside the sub tank 2*a* and compress the spring 2*c*. Thus, in the present embodiment, the tube pump 90 is reverse-rotated to return the ink inside the sub tank 2*a* to the ink cartridge 3*a*.

When the tube pump 90 is reverse-rotated to return the ink inside the sub tank 2*a* to the ink cartridge 3*a*, the tube pump 90 is stopped when the ink lower limit sensor 63 makes a detection, which detects a lower position than that of the ink empty detection sensor 62. The amount of returned ink at this time corresponds to the amount of ink sent by the tube pump 90 during the time from when the ink empty detection sensor 62 detects the filler 60 to when the ink lower limit sensor 63 detects the filler 60.

As described above, when replacing the recording head 1, the negative pressure inside the ink supply flow path is made higher than the negative pressure at the time of regular printing. Therefore, even when the coupling 50 is separated for replacing the head, ink does not drop from the separated portion. Accordingly, ink is prevented from leaking or dropping when replacing the head.

The negative pressure when replacing a recording head is set at a level so as not to take in air from the nozzle of the recording head 1 (not to damage the meniscus of the nozzle), in both the first and second embodiments. Accordingly, it is possible to prevent air from being taken in from the nozzle when replacing a head.

The present invention is not limited to the above description given with reference to drawings. The recording head (jetting head) may have an appropriate configuration. For example, as a pressure generating means, an arbitrary method such as a thermal method, a piezoelectric method, and an electrostatic method may be applied. The arrangements and numbers of the heads and head modules in a line engine are examples, and may be appropriately changed. The configurations and formats of the respective units in the image forming apparatus may be appropriately changed without departing from the scope of the present invention.

According to one embodiment of the present invention, the line engine does not require a manifold, and therefore, space-saving, low cost, and a highly efficient operation of replacing recording heads is realized. Furthermore, it is possible to reduce the amount of ink discarded after replacing a recording head, and ink filling can be performed within a short period of time.

The inkjet recording device is not limited to the specific embodiments described herein, and variations and modifications may be made without departing from the scope of the present invention.

The present application is based on Japanese Priority Patent Application No. 2012-054317, filed on Mar. 12, 2012, and Japanese Priority Patent Application No. 2012-181499, filed on Aug. 20, 2012, the entire contents of which are hereby incorporated herein by reference.

What is claimed is:

1. An inkjet recording device comprising:

a line engine including a plurality of recording heads to eject ink from nozzles, the plurality of recording heads being aligned in a main direction perpendicular to a recording medium transportation direction such that the plurality of recording heads cover a width of a recording medium, wherein an arbitrary one of the plurality of recording heads is replaceable; and an ink cartridge to retain ink to be supplied to the plurality of recording heads of the line engine, wherein each of the plurality of recording heads includes a head tank attached on the corresponding one of the plurality of recording heads to retain ink supplied from the ink cartridge and to supply ink to the corresponding one of the plurality of recording heads, and each of a plurality of the head tanks includes a supply port to receive ink supplied from the ink cartridge, a discharge port to discharge ink in the head tank, and a plurality of ink flow paths provided to each of the supply ports and the discharge ports of the plurality of the head tanks to connect the respective discharge ports and the supply ports of the head tanks that are adjacent to each other such that the plurality of the head tanks are connected in series by the plurality of ink flow paths;

a sub tank configured to retain the ink supplied from the ink cartridge and to supply the ink to the plurality of the head tanks;

a first supply path configured to connect the sub tank and the supply port of a most upstream side recording head among the plurality of recording heads that are connected by the respective discharge ports and the supply ports; and a second supply path configured to connect the sub tank and the discharge port of a most downstream side recording head among the plurality of recording heads that are connected by the respective discharge ports and the supply ports.

2. The inkjet recording device according to claim 1, further comprising:

a waste liquid flow path that is connected to the second supply path via a three-way switching valve.

3. The inkjet recording device according to claim 1, wherein the ink flow paths are made of a non-rigid flexible material, and each of the ink flow paths includes connection units at which the ink flow paths can be connected and separated so that each of the plurality of recording heads is replaceable.

4. The inkjet recording device according to claim 1, further comprising:

a waste liquid flow path that can be connected to the discharge port of a replacement recording head when replacing the arbitrary one of the plurality of recording heads.

5. The inkjet recording device according to claim 1, wherein the head tank includes a first liquid chamber and a second liquid chamber, a filter is disposed between the first liquid chamber and the second liquid chamber, the supply port and the discharge port are connected by the first liquid chamber, and each of the plurality of recording heads is connected to the corresponding second liquid chamber.

6. The inkjet recording device according to claim 1, further comprising:

a negative pressure forming unit configured to form negative pressure in an ink supply flow path through which the ink is supplied to the plurality of recording heads, wherein when replacing the arbitrary one of the plurality of recording heads, the negative pressure in the ink supply flow path is increased to a higher level than the negative pressure during regular printing.

7. The inkjet recording device according to claim 6, further comprising:

a sub tank configured to retain the ink, wherein the negative pressure forming unit is a suction unit configured to suction the ink from the plurality of recording heads, and when replacing the arbitrary one of the plurality of recording heads, the ink is restricted from being supplied to the sub tank.

8. The inkjet recording device according to claim 6, further comprising:

a sub tank configured to retain the ink, wherein the negative pressure forming unit is implemented by reverse-rotation of a supply pump configured to supply the ink to the sub tank.

9. The inkjet recording device according to claim 6, wherein when replacing the arbitrary one of the plurality of recording heads, the negative pressure in the ink supply flow path is set to a level so as not to damage a meniscus of a nozzle of each of the plurality of recording heads.

* * * * *